US008282067B2

(12) United States Patent
Schwoerer

(10) Patent No.: US 8,282,067 B2
(45) Date of Patent: Oct. 9, 2012

(54) CEILING JOIST FORMWORK WITH AUTOMATIC STRIPPING OF THE INNER BOARD

(75) Inventor: Artur Schwoerer, Senden (DE)

(73) Assignee: Peri GmbH, Weissenhorn (DE)

( * ) Notice: Subject to any disclaimer, the term of this patent is extended or adjusted under 35 U.S.C. 154(b) by 580 days.

(21) Appl. No.: 12/450,500

(22) PCT Filed: Apr. 2, 2008

(86) PCT No.: PCT/DE2008/000555

§ 371 (c)(1),
(2), (4) Date: Sep. 29, 2009

(87) PCT Pub. No.: WO2008/122273

PCT Pub. Date: Oct. 16, 2008

(65) Prior Publication Data

US 2010/0090088 A1 Apr. 15, 2010

(30) Foreign Application Priority Data

Apr. 7, 2007 (DE) ..... 10 2007 016 724

(51) Int. Cl.
*E04G 11/40* (2006.01)

(52) U.S. Cl. ..... 249/28; 249/27

(58) Field of Classification Search ..... 249/18, 249/26, 27, 28, 29, 30
See application file for complete search history.

(56) References Cited

U.S. PATENT DOCUMENTS 857,524 A * 6/1907 Hindman et al. ..... 249/29
910,515 A * 1/1909 Drayer ..... 249/26
1,470,673 A * 10/1923 Ambursen ..... 249/28

(Continued)

FOREIGN PATENT DOCUMENTS

DE 18 03 626 6/1970
DE 196 40 396 4/1998
DE 198 58 186 7/1999

(Continued)

OTHER PUBLICATIONS

"Anwenderinformation Dokamatic-Tisch" (User information Dokamatic-Table), company Doka Industrie GmbH, Amstetten, Austria Dec. 2005, pp. 30-31.

*Primary Examiner* — Michael Safavi
(74) *Attorney, Agent, or Firm* — Paul Vincent

(57) ABSTRACT

A ceiling joist formwork system (1) comprises a ceiling table (2), a vertical support (6), an inner board (3), a ceiling joist base (4), and an outer board (5), the outer board (5) and the ceiling joist base (4) being interconnected, especially rigidly interconnected. The vertical support (6) is rigidly fixed to the ceiling table (2), and the ceiling joist base (4) is fixed to the vertical support. The system is characterized in that the ceiling joist base (4) and the outer board (5) are rotatably mounted about a first articulated point (GP1) on the vertical support (6), a guide (7) is rigidly fixed to the inner board (3) and the guide (7) and the inner board (3) are rotatably mounted about a second articulated point (GP2) on the ceiling joist base (4). The inner board (3) is guided by means of an edge (14*a*, 14*b*) in relation to the ceiling table (2) along a direction comprising at least one component vertical to the formwork upper plane of the inner board (3). The ceiling joist formwork system can be used to simplify the dismantling, especially of the inner board, and the risk of damage to the inner board is reduced.

16 Claims, 4 Drawing Sheets

U.S. PATENT DOCUMENTS

| | | | | | |
|---|---|---|---|---|---|
| 2,166,576 | A | * | 7/1939 | Bauer | 249/28 |
| 3,735,953 | A | * | 5/1973 | Dashew et al. | 249/28 |
| 4,486,000 | A | * | 12/1984 | Klaiss | 249/28 |
| 5,676,874 | A | * | 10/1997 | Lee | 249/28 |

FOREIGN PATENT DOCUMENTS

| | | | |
|---|---|---|---|
| DE | 198 13 857 | | 2/2000 |
| DE | 100 38 659 | | 2/2002 |
| EP | 49880 | A1 * | 4/1982 |

* cited by examiner

CEILING JOIST FORMWORK WITH AUTOMATIC STRIPPING OF THE INNER BOARD

This application is the national stage of PCT/DE2008/000555 filed on Apr. 2, 2008 and also claims Paris Convention priority to DE 10 2007 016 724.7 filed on Apr. 7, 2007.

BACKGROUND OF THE INVENTION

The invention concerns a ceiling joist formwork system comprising a ceiling table, a vertical support, an inner board, a ceiling joist base and an outer board, wherein the outer board and the ceiling joist base are connected to each other, in particular in a rigid fashion, wherein the vertical support is rigidly mounted to the ceiling table, and wherein the ceiling joist base is mounted to the vertical support.

A ceiling joist formwork system of this type is disclosed in the company brochure "Anwenderinformation Dokamatic-Tisch" (User information Dokamatic-Table), company Doka Industrie GmbH, Amstetten, Austria, December 2005, pages 30-31.

Formwork technology enables the production of almost any structure from concrete, in particular walls and ceilings of buildings. A space is thereby initially delimited to the sides and to the bottom, in which the structure is to be produced (encasing). Formwork elements are used for this purpose. The delimited space is subsequently filled with liquid concrete. After hardening of the concrete, the formwork elements are removed (stripping of the formwork) and the finished concrete structure can be used or further processed.

The ceilings and the supports for the ceilings of many modern buildings are produced from concrete. The ceilings are provided with steel reinforcements in order to accept the loads that are produced. The thickness of the ceiling thereby depends on the load and the desired clear span.

Ceilings are conventionally provided with ceiling joists in order to reduce the thickness of the ceiling and thereby the amount of concrete that is used. A ceiling joist is a steel-reinforced concrete support that extends below the ceiling and is suited to distribute loads and respectively transfer loads to supports or load-bearing walls. A typical ceiling joist is a structure that projects in a downward direction from the ceiling panel at the edge of a ceiling.

A ceiling joist formwork system is required to produce a ceiling joist. The ceiling joist itself is thereby delimited by the form linings of an inner board, of a ceiling joist base and of an outer board. The form lining of the inner board thereby directly joins the form lining of a ceiling table.

An "edge table with ceiling joist" is disclosed in the company brochure "Anwenderinformation Dokamatic-Tisch". A ceiling joist butt strap is rigidly mounted to a ceiling table and an inner board is rigidly connected to the ceiling joist butt strap. A horizontal locking bar is also rigidly mounted to the ceiling joist butt strap, to which locking bar, in turn, a ceiling joist base is rigidly mounted as well as an outer board that can be hinged away.

The inner board of this conventional ceiling joist formwork system is normally stripped by lowering the ceiling table that is rigidly connected to the inner board. The inner board is thereby simultaneously separated from the finished concrete wall of the ceiling joist. A considerable force thereby acts on the inner board such that the inner board might be deformed or otherwise damaged. For this reason, the inner board must be frequently repaired or replaced. In order to prevent damage to the inner board, the inner board of the conventional ceiling joist formwork system would have to be initially separated from the ceiling table and be separately stripped which is, however, quite cumbersome and labor-intensive.

It is the underlying purpose of the present invention to provide a ceiling joist formwork system that facilitates stripping, in particular of the inner board, and reduces the risk of damage to the inner board.

SUMMARY OF THE INVENTION

This object is achieved by a ceiling joist formwork system of the above-mentioned type, which is characterized in that the ceiling joist base and the outer board are commonly disposed to be rotatable about a first hinge point on the vertical support, a guide is rigidly connected to the inner board, the inner board and the guide together are disposed on the ceiling joist base such that they can be rotated about a second hinge point, and the inner board is guided by means of an edge with respect to the ceiling table along a direction, wherein this direction has at least one component that extends perpendicularly to the form lining plane of the inner board.

The inventive ceiling joist formwork system permits simultaneous actuation (movement) of the inner board, outer board, and ceiling joist base during encasing and stripping. In accordance with the invention, when the inner board, outer board and the ceiling joist base are commonly actuated, the ceiling table remains stationary.

The direction along which the inner board is guided by the edge relative to the ceiling table has at least one component that extends perpendicularly to the form lining plane of the inner board (in the encased position). In other words, this direction does not extend parallel to the form lining plane of the inner board. In the encased position, the inner board is typically vertically aligned such that the direction along which the inner board is guided extends in a horizontal or at least partially horizontal direction. When the guide and the inner board are moved, guided by the edge, the (horizontal) separation between the inner board and the concrete wall that is to be produced or has been produced therefore changes. This is utilized in accordance with the invention, in particular for stripping the inner board.

The edge (or guide) that determines the movement of the inner board is generally located in the region of the end of the guide that is close to the inner board. In this case, the direction along which the edge extends, and the direction along which the inner board is guided, are substantially identical. This geometry minimizes the bearing forces. The edge that guides the guide (or its end close to the inner board) with respect to the ceiling table then also extends in a direction that has at least one component that extends perpendicularly to the form lining plane of the inner board.

The inner board, outer board and ceiling joist base are actuated only through gravity during stripping. Stripping can be realized e.g. through lowering a support that is disposed below the ceiling joist formwork system in the area of the ceiling joist base. When the support is lowered, the entire outer board and ceiling joist base pivot about the first hinge point following gravity away from the finished ceiling joist (stripping of ceiling joist base and outer board). Since the entire guide and inner board are mounted to the second hinge point on the ceiling joist base, the entire guide and inner board are thereby also automatically deflected. The movement of the guide is thereby guided by the edge, wherein the inner board that is mounted to the guide is pivoted away from the finished ceiling joist (stripping of inner board).

In other words, the edge extends in such a fashion that, when the outer board and the ceiling joist base together are rotated about the first hinge point due to gravity, a movement of the guide is generated in correspondence with the edge, wherein this movement withdraws, in particular pivots away, the inner board from the concrete wall (i.e. from the finished ceiling joist).

The guiding direction of the edge preferably extends in a vertical plane that extends perpendicularly to the form lining plane of the ceiling table and also perpendicularly to the form lining plane of the inner board. The relative motion of the ceiling table and the guide/inner board then also extends in the same vertical plane.

The edge that guides the guide and the inner board may be formed on the ceiling table, the vertical support, the guide, or also on the inner board. The edge cooperates with a counter means, e.g. a bolt, which is moved along the edge. When the edge is formed on the ceiling table or the vertical support, the counter means is formed on the guide or inner board or is disposed in a stationary fashion with respect to the guide and the inner board. When the edge is formed on the guide or the inner board, the counter means is formed on the ceiling table or the vertical support or is disposed in a stationary fashion with respect to the ceiling table and the vertical support.

The inventive ceiling joist formwork system is particularly suited to produce ceiling joists at the side edge of a ceiling. The first and second hinge points are typically disposed below the ceiling table in the encased position. They are thereby typically formed on a bottom locking bar of the ceiling joist base. The bottom locking bar thereby typically extends in an approximately horizontal direction in the encased position.

In accordance with the invention, the inner board defines the overall inner form lining and associated supports for the inner form lining. The outer board moreover defines the overall outer form lining and the associated supports (e.g. transverse locking bars and front locking bars). The ceiling joist base (or bottom board) equally defines the overall bottom form lining and the associated supports (e.g. transverse locking bars and bottom locking bars). The ceiling table comprises a ceiling form lining and associated supports (e.g. cross beams and main beams).

In a preferred embodiment of the inventive ceiling joist formwork system, the edge extends at an inclination with respect to the form lining plane of the inner board and at an inclination with respect to the form lining plane of the ceiling table. In a particularly compact construction, the guide can both follow the pivot motion of the overall ceiling joist base and outer board, and also effect withdrawal of the inner board due to the fact that the guiding edge extends at an inclination both with respect to the form lining plane of the ceiling table and also to the form lining plane of the inner board (viewed in a cross-sectional plane that extends perpendicularly with respect to these two form lining planes). The force that is required to release the inner board is provided by the weight of the outer board and the ceiling joist base. The engagement on the form lining of the inner board is thereby realized at an inclination in correspondence with the inclined edge to ensure gentle release of the form lining of the inner board from the concrete surface of the finished ceiling joist. This embodiment is typically used with an edge that is disposed on the end of the guide close to the inner board.

In a preferred embodiment of the inventive ceiling joist formwork system, the second hinge point is closer to the form lining plane of the inner board than the first hinge joint, and the edge extends along a direction in which the separation from the form lining of the ceiling table also increases with increasing separation from the form lining of the inner board. With this geometry, the second hinge point is pulled in a downward direction during stripping (removing the formwork) such that the guide and the inner board are also guided in a downward direction during stripping. This is favorable in view of the amount of space, in particular, of the ceiling form lining. Altogether, a simple construction can be realized in this fashion.

In another preferred embodiment, the edge subtends an angle of between 20° and 70° with respect to the form lining plane of the inner board and an angle of between 20° and 70° with respect to the form lining plane of the ceiling table. Angle relationships of this type facilitate transmission of forces. The angle relationships are valid for the encased state, however, they are regularly and preferably also given in the stripped state due to the typically minimum pivoting motion of the inner board.

In another particularly preferred embodiment, the edge is formed through at least one elongated hole in which a bolt extends. In accordance with the invention, several elongated holes may be used as an edge, in particular, for relatively large structures. Elongated holes permit exact and reliable guidance of the guide and, in particular, guidance of the guide on both sides.

In a preferred further development of this embodiment, the elongated hole is formed in the guide, and the bolt that extends therein is disposed in a stationary fashion with respect to the ceiling table. This embodiment has proven to be favorable in practice. In particular, the bolt can be borne in standardized holes or recesses of the ceiling table such that a conventional ceiling table can be used for the inventive ceiling joist formwork system without requiring any particular modifications. The bolt may be provided with a mounting handle.

In another preferred embodiment, a first stop, in particular an elongated hole end position is provided, which delimits the relative motion of the ceiling table and guide, wherein the first stop defines an encased position of the ceiling joist formwork system, in which the form lining planes of the ceiling table and the inner board subtend an angle of 90°, and in which the form lining planes of the inner board and the ceiling joist base subtend an angle of 90°. The encased position can be adjusted in a particularly simple fashion, e.g. by lifting a bottom locking bar of the ceiling joist base by means of a support until the first stop is reached.

In a preferred embodiment of the inventive ceiling joist formwork system, the first hinge point and the second hinge point are formed in each case by bolts, which particularly facilitates assembly and disassembly.

In a particularly preferred further development of this embodiment, the bolts project through holes in the vertical support and holes in the guide, wherein several holes are formed each on the vertical support and on the guide, which are disposed at a vertical separation from each other in the encased position. The height of the ceiling joist (i.e. the vertical extension of the ceiling joist perpendicularly to the form lining plane of the ceiling table) can be selected in a simple fashion through selection of the holes of the vertical support and the guide.

In another preferred further development of this embodiment, the bolts project through holes in the bottom locking bar, wherein several holes are formed in the bottom locking bar, which are spaced apart from each other in a horizontal direction in the encased position. The bottom locking bar is formed on the ceiling joist base. The width of the ceiling joist (i.e. the horizontal extension of the ceiling joist perpendicularly to the form lining plane of the inner board) can be selected in a simple fashion through selection of the hole in the bottom locking bar for the second hinge point.

In a preferred embodiment, a support is provided that engages below the ceiling joist base at a location that is disposed between the first hinge point and the end of the ceiling joist base facing the outer board. The ceiling joist formwork system can be encased or stripped by lifting or lowering the support.

In another particularly preferred embodiment, a second stop, in particular an elongated hole end position, is provided, which delimits the relative motion between the ceiling table and the guide, wherein the second stop delimits the common rotary motion of the ceiling joist base and the outer board about the first hinge point due to gravity in the encased position of the ceiling joist formwork system. For this reason, the inventive ceiling joist formwork system can be retained in a stripped position even without support. This facilitates assembly and disassembly.

In another embodiment that has proven to be favorable in practice, the vertical support is T-shaped and mounted to the ceiling table with the part that corresponds to the upper line of the T by means of bolts. In a particularly preferred fashion, one bolt is provided in the area of each of the two ends of the horizontally aligned upper line such that the forces that act in a vertical direction on the vertical support can be evenly distributed to both bolts or the part of the vertical support that corresponds to the upper line.

In an advantageous embodiment, a formwork junction bar having an h-shaped cross-section is provided, which surrounds the form lining of the ceiling table and is supported on top of the inner board in the encased position. The formwork junction bar seals the transition area between the ceiling table and the inner board. A space between the inner form lining and the form lining of the ceiling table, which is spanned by the formwork junction bar, facilitates pivoting of the inner board.

Another preferred embodiment is characterized in that the ceiling joist base has a bottom locking bar that extends parallel to the form lining plane of the bottom form lining of the ceiling joist base, part of the bottom locking bar projects past the side edge of the bottom form lining facing the inner board, and the first hinge point and the second hinge point are formed on the projecting part of the bottom locking bar. In accordance with the invention, several bottom locking bars may be provided, only one (or a few) of which project(s). The hinge joints are particularly easy to access due to the projecting bottom locking bar.

Finally, in another preferred embodiment, the guide extends substantially parallel to the form lining plane of the inner board and the vertical support substantially extends perpendicularly to the form lining plane of the ceiling table. This construction minimizes the forces and moments that act on the vertical support and the guide.

Further advantages of the invention can be extracted from the description and the drawing. The features mentioned above and below may be used in accordance with the invention either individually or collectively in arbitrary combination. The embodiments shown and described are not to be understood as an exhaustive enumeration but have exemplary character for describing the invention.

BRIEF DESCRIPTION OF THE DRAWING

The invention is illustrated in the drawing and explained in more detail with reference to embodiments.

DESCRIPTION OF THE PREFERRED EMBODIMENT

Figure 1:
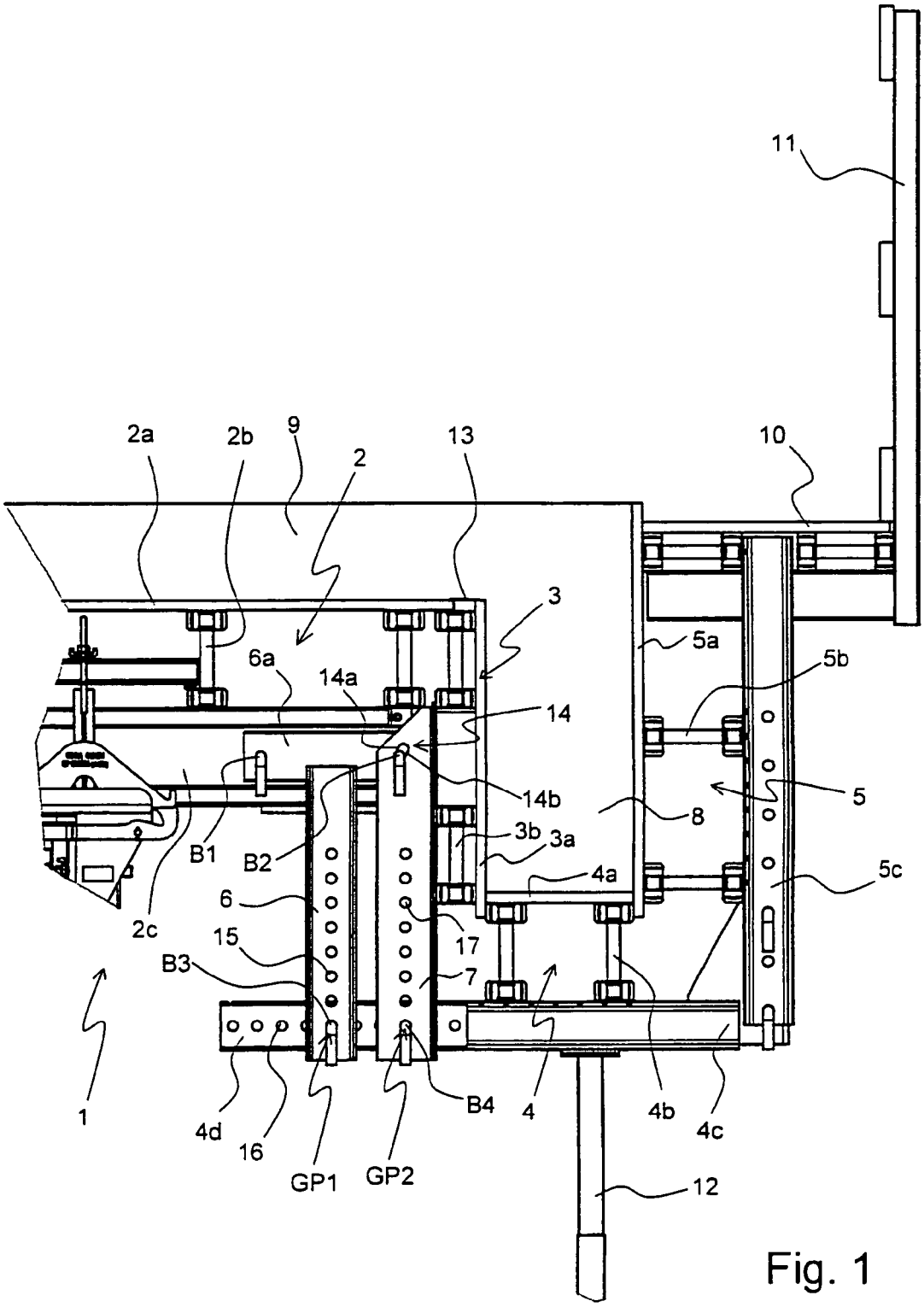
FIG. 1 shows a schematic cross-sectional view of an inventive ceiling joist formwork system in the encased position.

FIG. 1 schematically shows an inventive ceiling joist formwork system 1. The ceiling joist formwork system 1 comprises a ceiling table 2, an inner board 3, a ceiling joist base 4, an outer board 5, a vertical support 6 and a guide 7. The ceiling joist formwork system 1 is used to produce a ceiling joist 8 from concrete that directly joins a concrete ceiling 9 and has a greater extension than the lower side of the ceiling 9.

The ceiling table 2 has a flat ceiling form lining 2*a*, several cross beams (in the present case I-beams) 2*b*, and main beams 2*c* (of which only the foremost main beam is visible in the cross-sectional view of FIG. 1). The inner board 3 has a flat inner form lining 3*a* and different supports 3*b*. The ceiling joist base 4 has a flat bottom form lining 4*a*, cross beams (in the present case I-beams) 4*b*, and bottom locking bars 4*c*, 4*d*. The bottom locking bar 4*d* extends as far as below the ceiling table 2. A support 12 engages below the ceiling joist base 4 below the ceiling joist 8. The outer board 5 has a flat outer form lining 5*a*, several cross beams (in the present case I-beams) 5*b*, and front locking bars 5*c* (of which only the foremost front locking bar is visible in the cross-sectional view of FIG. 1). The ceiling joist base 4 and the outer board 5 are rigidly connected to each other. A table platform 10 with railing 11 is mounted to the outer board 5, on which construction workers can walk.

The form lining planes of all form linings 2*a*, 3*a*, 4*a*, 5*a* are perpendicular with respect to the vertical plane of the drawing of FIG. 1. The form linings 3*a*, 4*a*, 5*a* surround the ceiling joist 8 with sufficient tightness in order to prevent liquid concrete from leaking. All neighboring form linings abut each other at an angle of 90°, in each case. A space between the ceiling form lining 2*a* and the inner form lining 3*a* is bridged by an h-shaped formwork junction bar 13 which is supported on the upper narrow side of the inner form lining 3*a* and surrounds the ceiling form lining 2*a*.

The T-shaped vertical support 6 is rigidly connected to the ceiling table 2, i.e. to the main beam 2*c*, in the area of the part that corresponds to the upper line 6*a* of the T by means of two bolts B1, B2. The bolts B1, B2 have angled handles (see FIG. 4) and project through bores in the vertical support 6 and the main beam 2*c*. The bolt B2 additionally also projects through an elongated hole 14 of the guide 7. Several holes 15 are formed below one another in the vertically extending part of the vertical support 6. The lowermost hole is used as a first hinge point GP1. A bolt B3 extends in this hole and also projects through a hole in the bottom locking bar 4*d*. The bottom locking bar 4*d* and thereby the overall ceiling joist base 4 and outer board 5 are disposed on the vertical support 6 such that they can be rotated about the hinge point GP1. The bottom locking bar 4*d* has numerous further holes 16 that are disposed next to each other.

One hole of the bottom locking bar 4*d* is used as a second hinge point GP2. A bolt B4 projects through this hole and additionally also projects through a hole of the guide 7. The guide 7 is thereby disposed to be rotatable about the bottom locking bar 4*d* on the second hinge point GP2. Further holes 17 are formed on top of each other in the guide 7. The inner board 3 is rigidly connected to the guide 7. The guide 7 thereby provides a connection between the second hinge point GP2 and the inner board.

The different holes 15, 16, 17 in the vertical support 6, in the bottom locking bar 4*d*, and in the guide 7 represent alternative positions for the hinge points GP1, GP2 in case other ceiling joist base 8 dimensions are desired.

The position of rotation of the guide 7 about the second hinge point GP2 is determined by the elongated hole 14 of the guide 7. The bolt B2 that is disposed in the elongated hole 14 and is stationary with respect to the ceiling table 2 rests against, in particular, a left-hand upper long side 14*a* and a right-hand lower long side 14*b* of the elongated hole 14. The long sides 14*a*, 14*b* represent edges 14*a*, 14*b* that guide the relative motion of the guide 7 and the ceiling table 2 on both sides. The edges 14*a*, 14*b* extend parallel to each other, in FIG. 1, approximately along a direction from the right-hand upper side to the left-hand lower side in the vertical plane of the drawing of FIG. 1. The edges 14*a*, 14*b* thereby extend at an angle with respect to the vertical inner form lining 3*a* and at an angle with respect to the horizontal ceiling form lining 2*a*.

In a defined position of rotation of the bottom locking bar 4*d* about the first hinge point GP1 and thereby at a certain height of the second hinge point GP2, only one position of rotation of the guide 7 about the second hinge point GP2 is possible due to the elongated hole 14 being the guidance of the guide 7.

In the encased position of the ceiling joist formwork system 1 of FIG. 1, the dead weight of the inner board 3, ceiling joist base 4 and outer board 5 (including superstructures) is held via the first hinge point GP1 and mainly via the support 12. It must be noted that the support 12 cannot be moved any further upwards, since the bolt B2 prevents any further upward movement of the guide 7. The bolt B2 already rests against the elongated hole 14 in the lower elongated hole end position. In this respect, the elongated hole 14 forms a first stop.

When the support 12 is lowered (FIG. 2) the overall ceiling joist base 4 and outer board 5 (including superstructures) pivot about the stationary first hinge point GP1 in the clockwise direction to the right-hand lower side (see arrow 21*a*).

The second hinge point that is formed on the bottom locking bar 4*d* of the ceiling joist base is thereby shifted in a downward direction (the slight movement to the left can be neglected in the present case). In consequence thereof, the guide 7 including elongated hole 14 are also moved in a downward direction (see arrow 21*b*).

Since the bolt B2 is in the elongated hole 14 of the guide 7, the lower end of the guide close to the hinge point can only be moved in a downward direction when the upper end of the guide 7 close to the inner board is simultaneously moved parallel to the long sides of the elongated hole 14, in particular along the edge 14*a*. The bolt B2 urges the upper guide end to the left-hand side, in particular via the upper edge 14*a* of the elongated hole 14, while the lower guide end is lowered. In total, the upper end of the guide 7 is thereby moved to the left in a downward direction (see direction of arrow 21*c*) in correspondence with the direction of extension of the edge 14*a* (i.e. both away from the concrete wall of the ceiling joist 8 delimited by the inner form lining 3*a* and also away from the ceiling form lining 2*a*). This requires a slight pivoting movement of the guide 7 about the second hinge point GP2 in an anti-clockwise direction (see arrow 21*d*).

The inner board 3 that is rigidly connected to the guide 7 joins this pivoting movement that pivots the inner form lining 3*a* away from the ceiling joist 8, thereby stripping the inner board 3. A gap 22 is created between the ceiling joist 8 and the inner form lining 3*a*.

Figure 2:
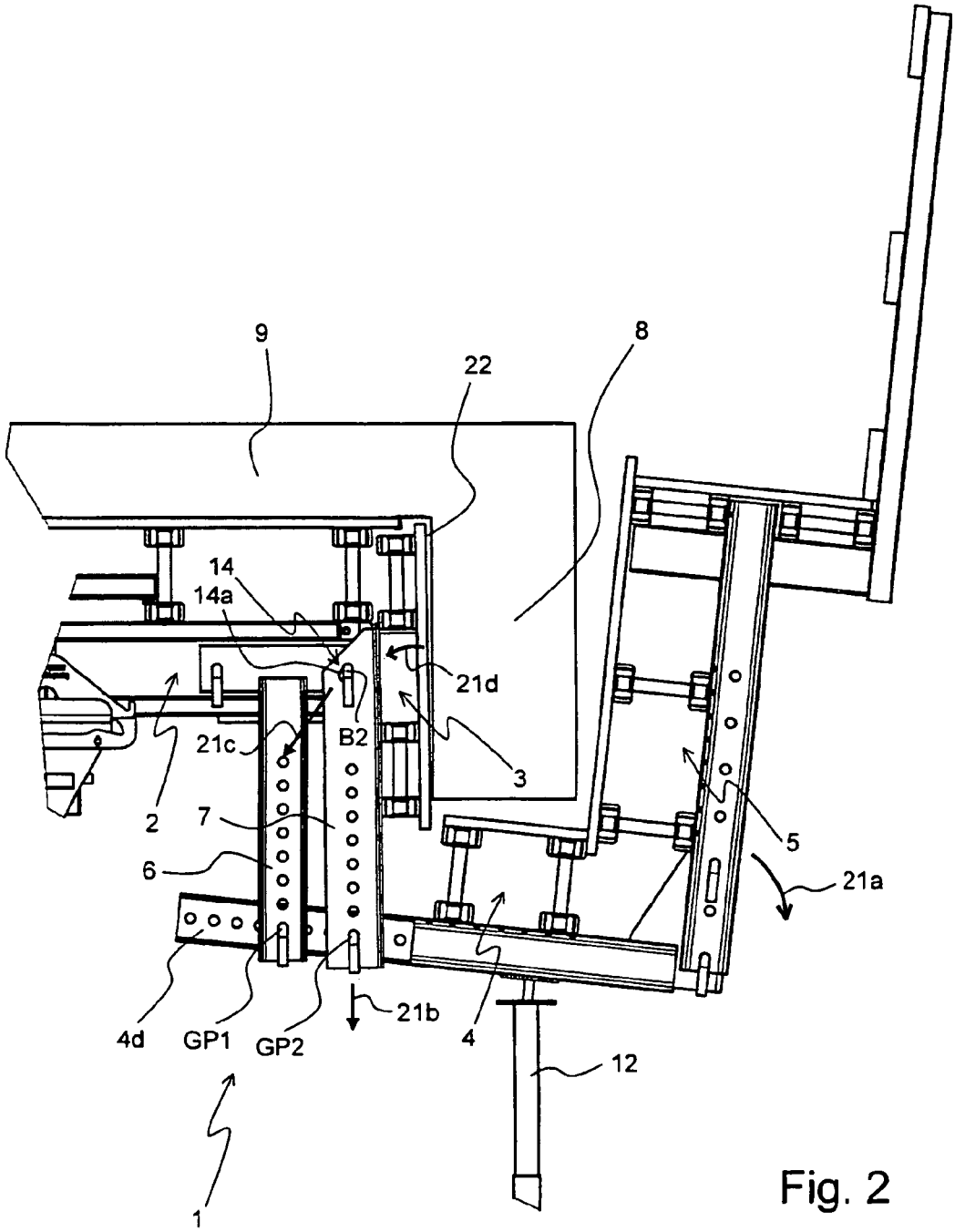
FIG. 2 shows the ceiling joist formwork system of FIG. 1 in the stripped position.

In the stripped position shown in FIG. 2, the bolt B2 rests against the elongated hole 14 in the upper elongated hole end position. This blocks further lowering of the guide 7 and of the second hinge point GP2. In consequence thereof, the bottom locking bar 4*d* can also no longer be pivoted further in the direction of the arrow 21*a*. The bolt B2 thereby has reached a second stop in the upper elongated hole end position that delimits the relative movement of guide 7 and ceiling table 2. In the illustrated position, the weight of inner board 3, ceiling joist base 4 and outer board 5 including superstructures is substantially held via the bolt B2. The vertical support 6 is subjected to compressive forces.

The support 12 does not bear any load and can be removed without difficulty. The complete ceiling joist formwork system 1 can be disassembled and e.g. be used for producing a ceiling joist on the ceiling of a higher storey.

In the embodiment of FIGS. 1 and 2, the edge 14*a* and the associated counter means, i.e. the bolt B2, are disposed directly above the second hinge point GP2. The first hinge point GP1 is disposed further out than the second hinge point GP2. For this reason, the mechanism for stripping the inner board 3 can be designed in a particularly compact fashion (see in particular the substantially vertically extending guide 7).

Figure 3:
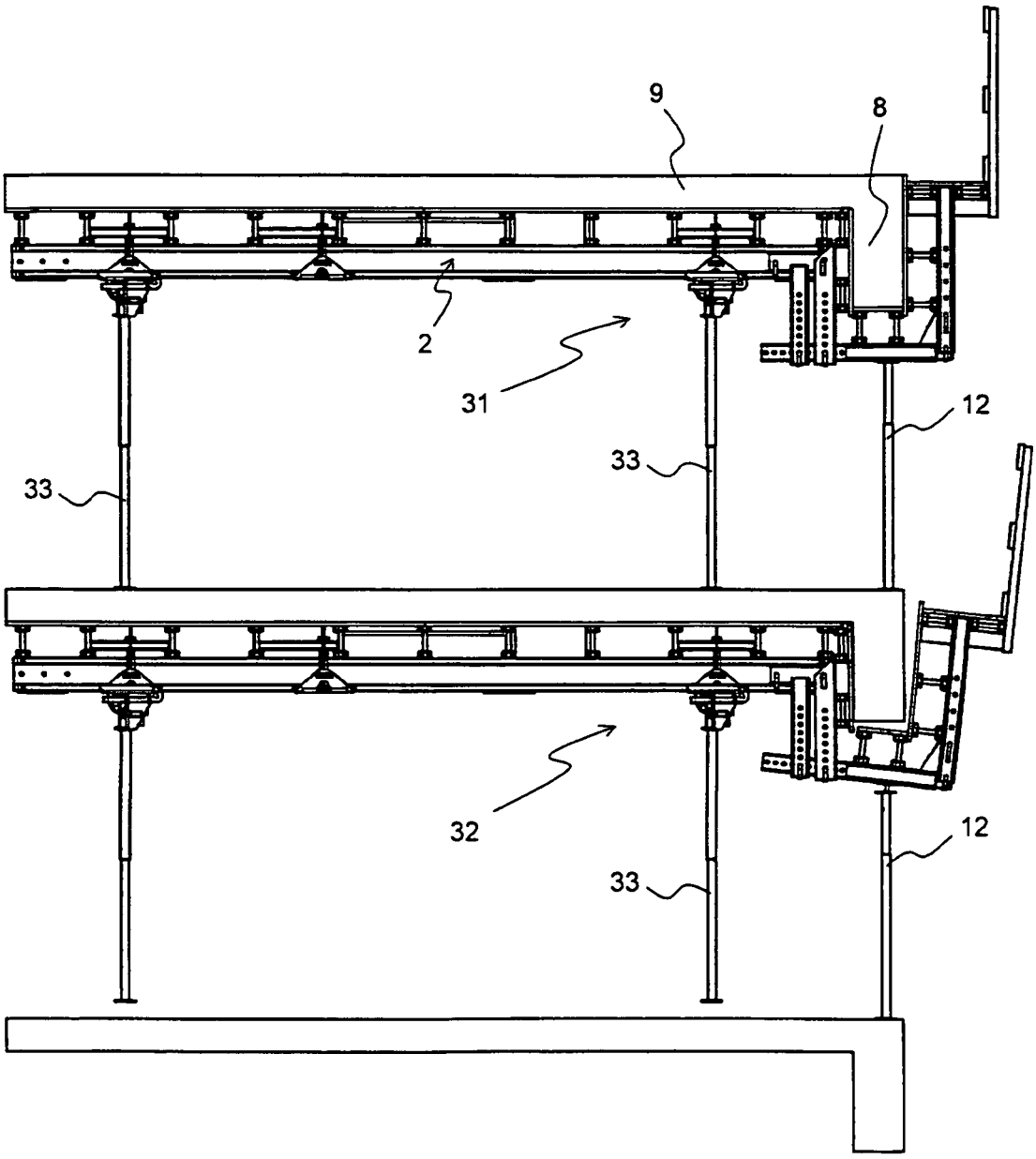
FIG. 3 shows a schematic cross-sectional view of an arrangement with two inventive ceiling joist formwork systems that are disposed on top of each other.

FIG. 3 shows an arrangement with an encased inventive ceiling joist formwork system 31 at the top (see FIG. 1) and an inventive ceiling joist formwork system 32 below, in which the inner board, the ceiling joist base and the outer board are in the stripped position (see FIG. 2). Supports 33 support the ceiling table 2 of the upper ceiling joist formwork system 31 on the underlying storey.

Figure 4:
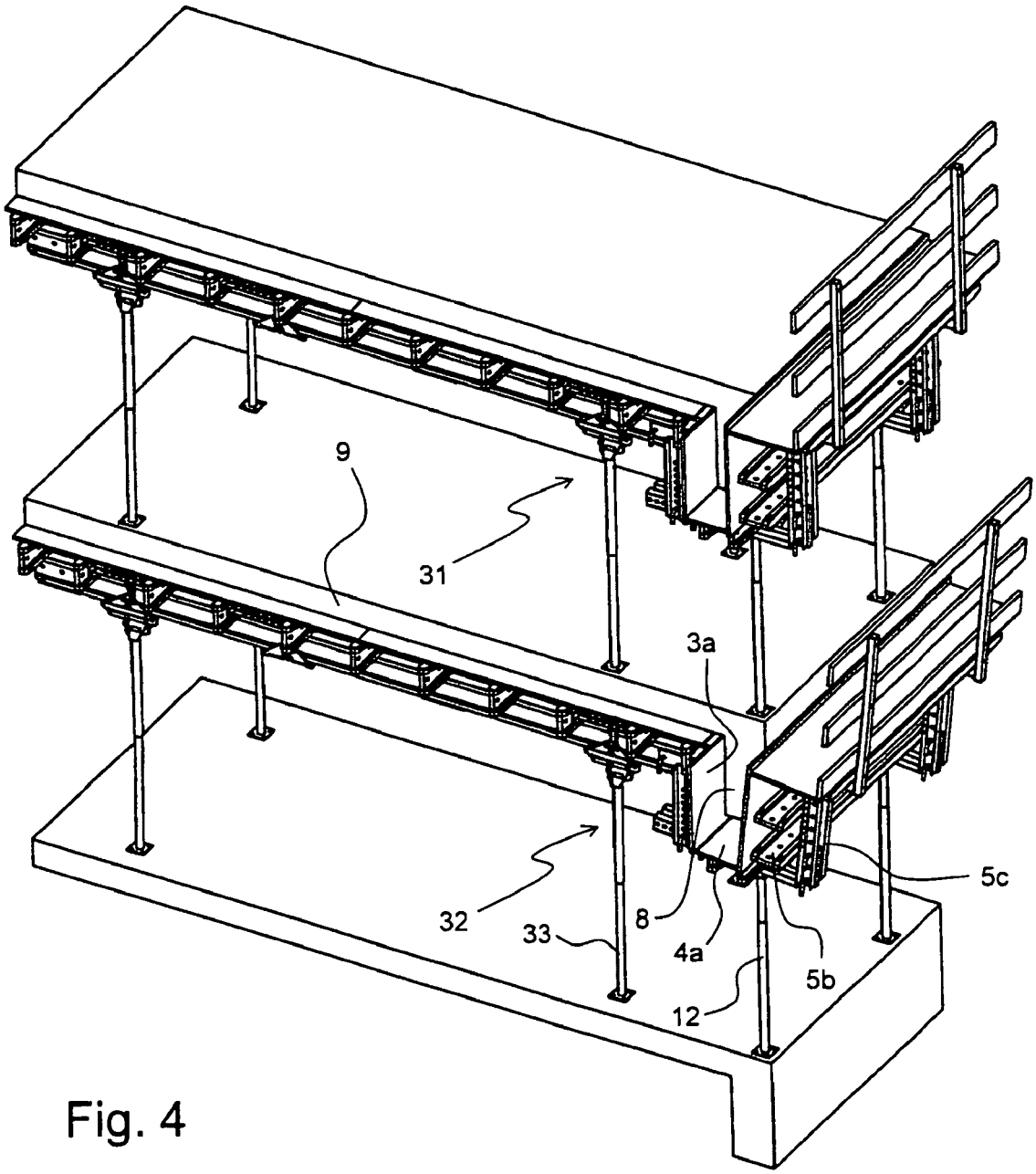
FIG. 4 shows a schematic perspective view of the arrangement of FIG. 3.

FIG. 4 shows the arrangement of FIG. 3 in a schematic perspective view, including the supports 33 for the ceiling tables 2. The front parts of the ceilings 9 and ceiling joists 8 were omitted in each case for reasons of clarity.

In summary, the invention describes a ceiling joist formwork for a ceiling table, in particular, an edge table, wherein the inner board, the ceiling joist base (bottom board) and outer board can be commonly actuated, in particular during stripping, by means of gravity. The ceiling joist formwork is rotatably disposed on a first hinge point on a vertical support of the ceiling table. The common pivoting motion of the ceiling joist base and the outer board about the first hinge point is deflected into an at least partially horizontal movement of the inner board by means of a second hinge point on the ceiling joist base and a guide. Towards this end, a guide, in the simplest case formed by one or more edges is used, which enforces a relative movement of the inner board and the ceiling table (that remains stationary during stripping of the ceiling joist) that is suitable for stripping.

I claim:

1. A ceiling joist formwork system comprising:

a ceiling table;

a vertical support rigidly mounted to said ceiling table, said vertical support having a first hinge point;

an inner board;

a ceiling joist base mounted to said vertical support, said ceiling joist base having a second hinge point;

an outer board cooperating with or rigidly cooperating with said ceiling joist base, wherein said ceiling joist base and said outer board are disposed for rotation about said first hinge point;

a guide rigidly connected to said inner board, wherein said inner board and said guide are disposed for mutual rotation about said second hinge point; and means defining an edge, wherein said inner board is guided by said edge for movement relative to said ceiling table along a direction, said direction having at least one component that extends perpendicularly to a form lining plane of said inner board.

2. The ceiling joist formwork system of claim 1, wherein said edge extends at an inclination with respect to said form lining plane of said inner board and at an inclination with respect to a form lining plane of said ceiling table.

3. The ceiling joist formwork system of claim 1, wherein said second hinge point is closer to said form lining plane of said inner board than said first hinge point, said edge extending along a direction in which a separation from a form lining of said ceiling table also increases with increasing separation from a form lining of said inner board.

4. The ceiling joist formwork system of claim 2, wherein said edge subtends an angle of between 20° and 70° with respect to said form lining plane of said inner board and an angle of between 20° and 70° with respect to said form lining plane of said ceiling table.

5. The ceiling joist formwork system of claim 1, wherein said edge is formed through at least one elongated hole in which a bolt extends.

6. The ceiling joist formwork system of claim 5, wherein said elongated hole is formed in said guide and said bolt that extends therein is disposed in a stationary fashion with respect to said ceiling table.

7. The ceiling joist formwork system of claim 1, wherein a first stop or an elongated hole end position delimits relative movement of said ceiling table and said guide said first stop defining an encased position of the ceiling joist formwork system in which said form lining planes of said ceiling table and said inner board subtend an angle of 90° and in which form lining planes of said inner board and said ceiling joist base subtend an angle of 90°.

8. The ceiling joist formwork system of claim 1, wherein said first hinge point and said second hinge point are each formed by bolts.

9. The ceiling joist formwork system of claim 8, wherein said bolts project through holes in said vertical support and holes in said guide, wherein several holes are formed in each of said vertical support and said guide, said several holes being spaced apart from each other in a vertical direction in an encased position.

10. The ceiling joist formwork system of claim 8, wherein said bolts project through holes in a bottom locking bar, wherein several holes are formed in said bottom locking bar and are spaced apart from each other in a horizontal direction in an encased position.

11. The ceiling joist formwork system of claim 1, further comprising a support that engages below said ceiling joist base at a location that is disposed between said first hinge point and an end of said ceiling joist base facing said outer board.

12. The ceiling joist formwork system of claim 1, wherein a second stop or an elongated hole end position delimits relative movement of said ceiling table and said guide, said second stop delimiting a common rotary motion of said ceiling joist base and said outer board about said first hinge joint due to gravity in a stripped position of the ceiling joist formwork system.

13. The ceiling joist formwork system of claim 1, wherein said vertical support is T-shaped, wherein an upper line of said T is mounted to said ceiling table by means of bolts.

14. The ceiling joist formwork system of claim 1, further comprising a formwork junction bar having an h-shaped cross-section, said junction bar surrounding a form lining of said ceiling table and supported on top of said inner board in an encased position.

15. The ceiling joist formwork system of claim 1, wherein said ceiling joist base has a bottom locking bar that extends parallel to a form lining plane of a bottom form lining of said ceiling joist base, wherein a portion of said bottom locking bar projects past a side edge of a bottom form lining facing said inner board, said first hinge point and said second hinge point being formed on said projecting portion of said bottom locking bar.

16. The ceiling joist formwork system of claim 1, wherein said guide substantially extends parallel with respect to said form lining plane of said inner board and said vertical support substantially extends perpendicularly with respect to a form lining plane of said ceiling table.

* * * * *